US006478538B2

(12) United States Patent
Kim

(10) Patent No.: US 6,478,538 B2
(45) Date of Patent: Nov. 12, 2002

(54) TURBO FAN HOUSING IN WINDOW TYPE AIR CONDITIONER

(75) Inventor: Sung Chun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/799,606

(22) Filed: Mar. 7, 2001

(65) Prior Publication Data

US 2002/0039529 A1 Apr. 4, 2002

(30) Foreign Application Priority Data

Sep. 30, 2000 (KR) ..... 00-57633

(51) Int. Cl.[7] ..... F04D 29/40
(52) U.S. Cl. ..... 415/204; 415/206
(58) Field of Search ..... 415/203, 204, 415/205, 206

(56) References Cited

U.S. PATENT DOCUMENTS 3,811,790 A * 5/1974 Mikulina et al. ..... 415/145
4,090,813 A * 5/1978 Minato et al. ..... 416/184
4,884,946 A * 12/1989 Belanger et al. ..... 415/206
4,917,572 A * 4/1990 Van Houten ..... 415/206
5,279,515 A * 1/1994 Moore et al. ..... 415/119
5,839,397 A * 11/1998 Funabashi et al. ..... 123/41.01

* cited by examiner

*Primary Examiner*—Edward K. Look
*Assistant Examiner*—Ninh Nguyen
(74) *Attorney, Agent, or Firm*—Birch, Stewart, Kolasch & Birch, LLP

(57) ABSTRACT

Turbo fan housing in a window type air conditioner including a flow guide including an inlet plate having a bell mouth for guiding room air, a base plate opposite to the inlet plate having an indoor fan mounted thereto for drawing the room air, and a separation wall between the inlet plate and the base plate to surround the turbo fan, an outlet formed by extension of the base plate and the separation wall from an opening formed on one side of the flow guide, and a cutoff formed on an inside of the separation wall connecting the outlet and the flow guide, wherein the indoor fan is a turbo fan, and a flow passage in the flow guide is formed to cause sharp flow direction changes, for converting a portion of dynamic pressure of the room air into a static pressure in the flow direction changes.

6 Claims, 6 Drawing Sheets

TURBO FAN HOUSING IN WINDOW TYPE AIR CONDITIONER

BACKGROUND OF THE INVENTION

1. Field of the Invention

The present invention relates to a window type air conditioner, and more particularly, to a turbo fan housing in an indoor part of a window type air conditioner.

2. Background of the Related Art

FIG. 1 illustrates a longitudinal section of a related art window air conditioner having a sirocco fan applied thereto, inclusive of an indoor part 10 and an outdoor part 20.

The indoor part 10 is provided with an indoor heat exchanger 11 in a front portion thereof, and an indoor fan 12 on an inner side thereof for forced flow of room air into the indoor part 10 through the indoor heat exchanger 11. The indoor fan 12 is surrounded by a fan housing 13 which guides the room air in/out of the indoor part 10. There is an outdoor heat exchanger 21 in a rear portion of the outdoor part 20, and an outdoor fan 23 on an inner side of the outdoor heat exchanger 21 for forced in/out of outdoor air through the outdoor part 20. There is a shroud 24 between the outdoor fan 23 and the outdoor heat exchanger 21, for guiding the outdoor air to the outdoor heat exchanger 21 and therefrom to a rear of the window air conditioner. In the meantime, the indoor fan 12 and the outdoor fan 23 are coupled to both ends of a motor 25 shaft for receiving rotation forces. And, there is a compressor 26 connected to the indoor and outdoor heat exchangers 11 and 21 through a refrigerant tube 27 having a capillary tube(not shown). Since the foregoing window type air conditioner requires a large flow rate, and a high static pressure air, as the indoor fan 12, a sirocco fan(given a reference symbol "12"), a kind of centrifugal multi-blade blower, is used as the indoor fan 12 for meeting the above requirements.

FIG. 2 illustrates a section of the fan housing across line I—I in FIG. 1. Referring to FIG. 2, the sirocco fan 12 is provided with a disk formed main plate 122, a rotating shaft 123 on a center of the main plate 122, a plurality of blades 121 fitted along a circumference of the main plate 122 parallel to the rotating shaft 123, and a rim 124 fixed to free ends of the blades 121. In this instance, the blade 121 is backward curved, with an outlet angle $\alpha$ greater than 90°, to enhance an inflow, and a smooth outflow of the room air.

FIG. 3 illustrates a partial perspective view of a fan housing 13 having a related art sirocco fan 12 provided thereto. Referring to FIGS. 1 and 3, the fan housing 13 is provided with a flow guide 131 for accumulating room air discharged from the sirocco fan 12 to form a large quantity of air, and to convert a portion of dynamic pressure of the room air into a static pressure, and a discharge part 132 for discharging the room air through a front face of the window type air conditioner. The flow guide 131 has an inlet plate 131*b* having a bell mouth 131*a* formed therein for guiding the room air, a base plate 131*c* having a rotating shaft 123 of the sirocco fan 12 mounted therein, and a separation wall 131*d* between the inlet plate 131*b* and the base plate to surround the sirocco fan 12 in a scroll form. And, there is an opening 131*e* on one side of the flow guide 131, from which the base plate 131*c* and the separation wall 131*d* are extended to form an outlet 132. And, there is a cutoff 133 of a triangular section on an inside of the separation wall 131*d* connecting a lower portion of the opening 131*e* in the flow guide 131 and a lower portion of the outlet 132, with a peak higher than a bottom of the outlet 132, for dropping a speed of the room air when the room air flows from the flow guide 131 to the outlet 132, to convert a portion of the dynamic pressure into a static pressure.

When the window type air conditioner is put into operation, the compressor 26 comes into operation so that the refrigerant is involved in compression, condensation, expansion, and evaporation as the refrigerant passes through the compressor 26, the outdoor heat exchanger 21, the capillary tube in the refrigerant tube 27, and the indoor heat exchanger 11. Consequently, the indoor heat exchanger 11 is at a temperature lower than the indoor part, and the outdoor heat exchanger 21 is at a temperature higher than the outdoor part. In the meantime, on the same time with the operation of the compressor 26, the motor 25 also comes into operation to start operation of the sirocco fan 12 and the outdoor fan 23, too. The room air passes, and has a heat exchanged through the indoor heat exchanger 11 as the sirocco fan 12 rotates, and is converted into a low temperature room air. Then, the room air flows in/out of the sirocco fan 12, to flow in a flow passage formed by the sirocco fan 12 and the flow guide 131. The flow passage has a smooth streamlined as the separation wall surrounds the sirocco fan 12 in a scroll form, to facilitate a smooth flow of the room air. However, a section of the flow passage becomes the larger in a direction of the air flow, to reduce a speed of room air as the room air flows along the flow passage, with a rise of the static pressure of the room air as a portion of the dynamic pressure of the room air is converted into a static pressure. Particularly, the static pressure of the room air rises sharply since the speed of the room air drops sharply as the room air passes over the cutoff 133. Eventually, the room air discharged to forward of the window type air conditioner through the outlet 132 has a high static pressure. On the other hand, the outdoor air has a heat exchanged into a high temperature outdoor air as the outdoor air flows through the outdoor heat exchanger 21 via outdoor air inlet holes 22 by the outdoor fan 23, and is discharged out of the outdoor part 20.

However, the window type air conditioner having the related art sirocco fan 12 applied thereto has the following problems.

First, though the sirocco fan has a high pressure and a high flow rate of air, the sirocco fan has a poor fan efficiency, to increase power consumption of the fan motor, resulting in a poor efficiency of the window type air conditioner system.

Second, commercially available turbo fans have a fan efficiency significantly higher than the sirocco fan. However, the turbo fan can not be applied to the indoor fan of the window type air conditioner since the turbo fan has a static pressure and a flow rate poorer than the sirocco fan, when the turbo fan and the sirocco fan are compared in the bulk size basis.

SUMMARY OF THE INVENTION

Accordingly, the present invention is directed to a turbo fan housing in a window type air conditioner that substantially obviates one or more of the problems due to limitations and disadvantages of the related art.

An object of the present invention is to provide a turbo fan housing in a window type air conditioner, which can provide adequate flow rate and static pressure even if a turbo fan is applied to the window type air conditioner.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the turbo fan housing in a window type air conditioner including a flow guide including an inlet plate having a bell mouth for guiding room air, a base plate opposite to the inlet plate having an indoor fan mounted thereto for drawing the room air, and a separation wall between the inlet plate and the base plate to surround the turbo fan, an outlet formed by extension of the base plate and the separation wall from an opening formed on one side of the flow guide, and a cutoff formed on an inside of the separation wall connecting the outlet and the flow guide, wherein the indoor fan is a turbo fan, and a flow passage in the flow guide is formed to cause sharp flow direction changes, for converting a portion of dynamic pressure of the room air into a static pressure in the flow direction changes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
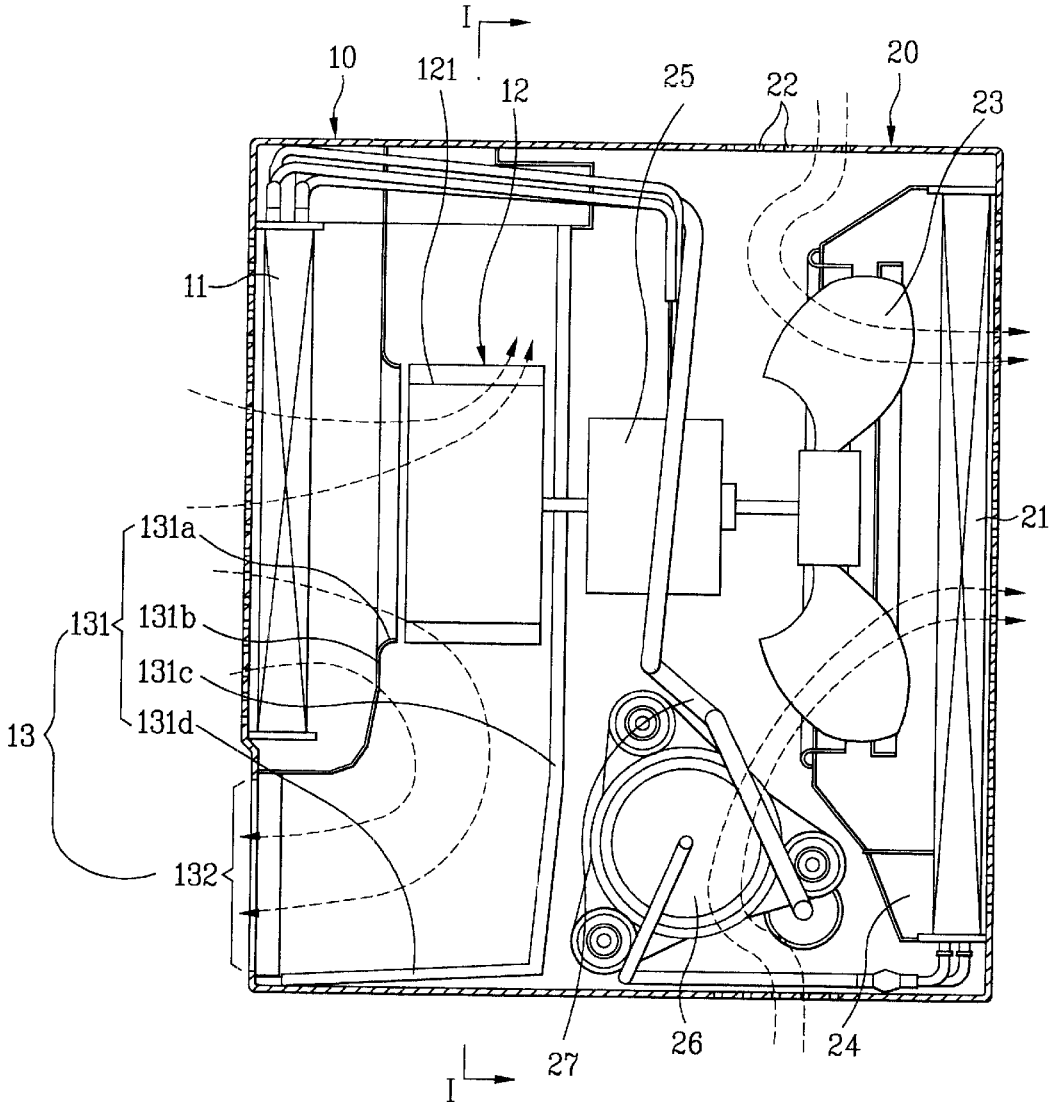
FIG. 1 Prior Art
FIG. 1 illustrates a longitudinal section of a related art window air conditioner having a sirocco fan applied thereto.
Figure 2:
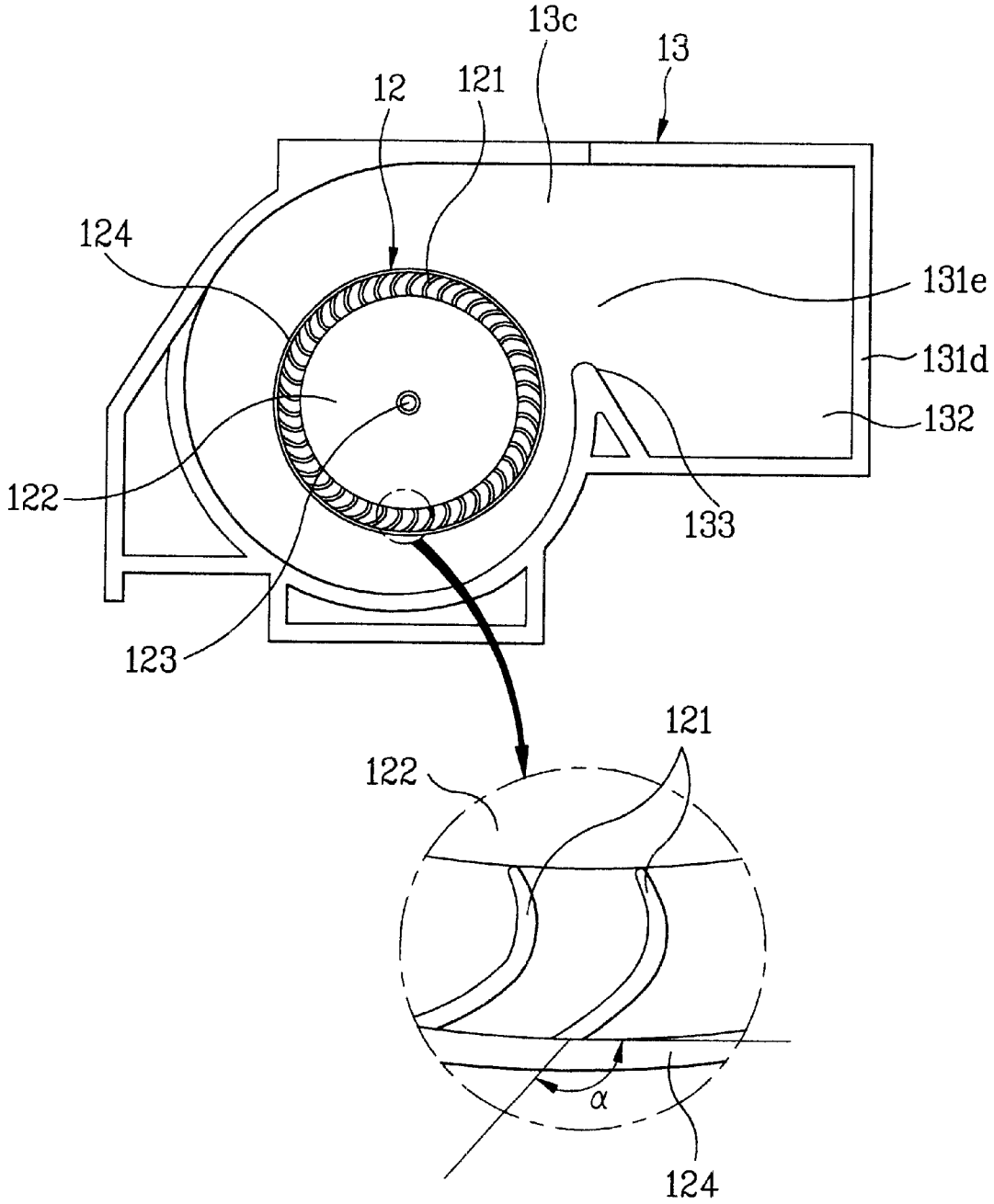
FIG. 2 Prior Art
FIG. 2 illustrates a section of a fan housing across a line I—I in FIG. 1.
Figure 3:
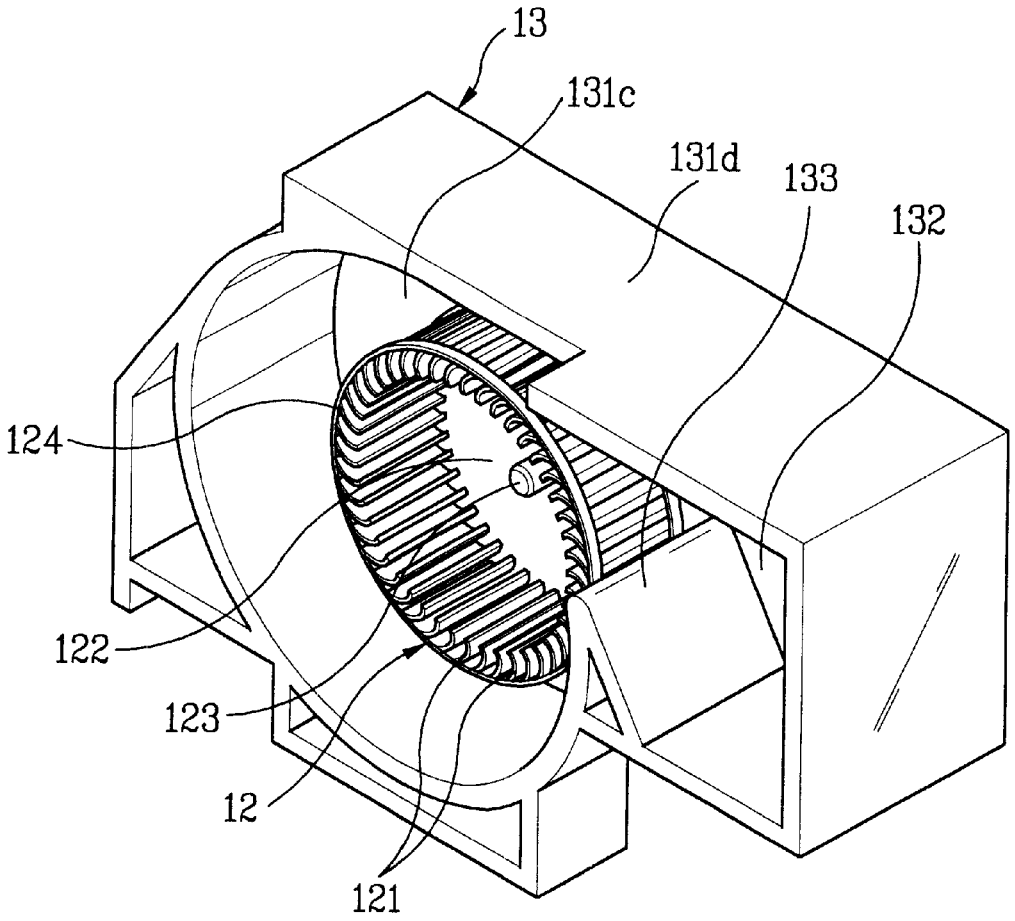
FIG. 3 Prior Art
FIG. 3 illustrates a partial perspective view of a fan housing having a related art sirocco fan applied thereto.
Figure 4:
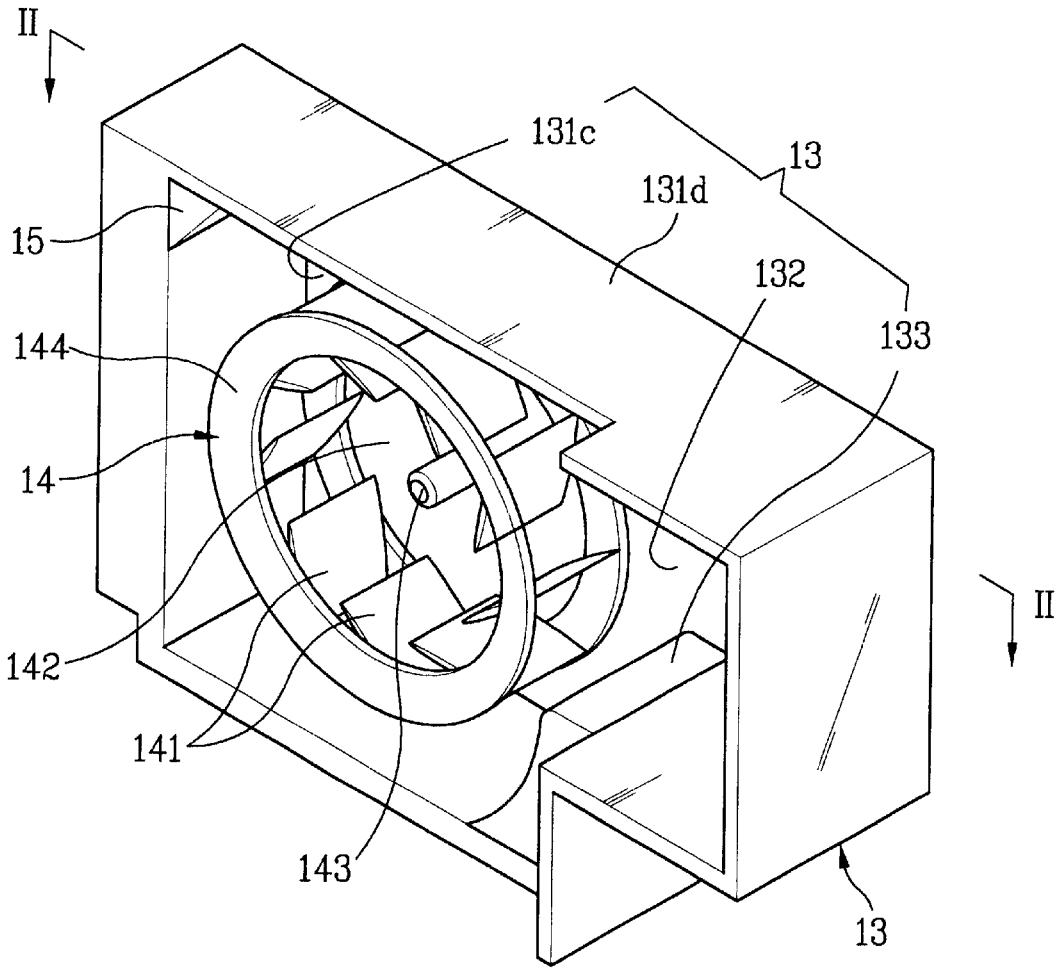
FIG. 4 illustrates a partial perspective view of a turbo fan housing having an inlet plate removed therefrom in accordance with a preferred embodiment of the present invention.

Reference will now be made in detail to the preferred embodiments of the present invention, examples of which are illustrated in the accompanying drawings. In the accompanying drawings, components identical to the related art are given identical reference symbols, and explanation of which is omitted. FIG. 4 illustrates a partial perspective view of a turbo fan housing having an inlet plate removed therefrom in accordance with a preferred embodiment of the present invention, FIG. 5 illustrates a section across a line II—II in FIG. 4 showing a turbo fan housing having an indoor heat exchanger and an inlet plate of the present invention applied thereto, and FIG. 6 illustrates a front view of FIG. 5.

Figure 5:
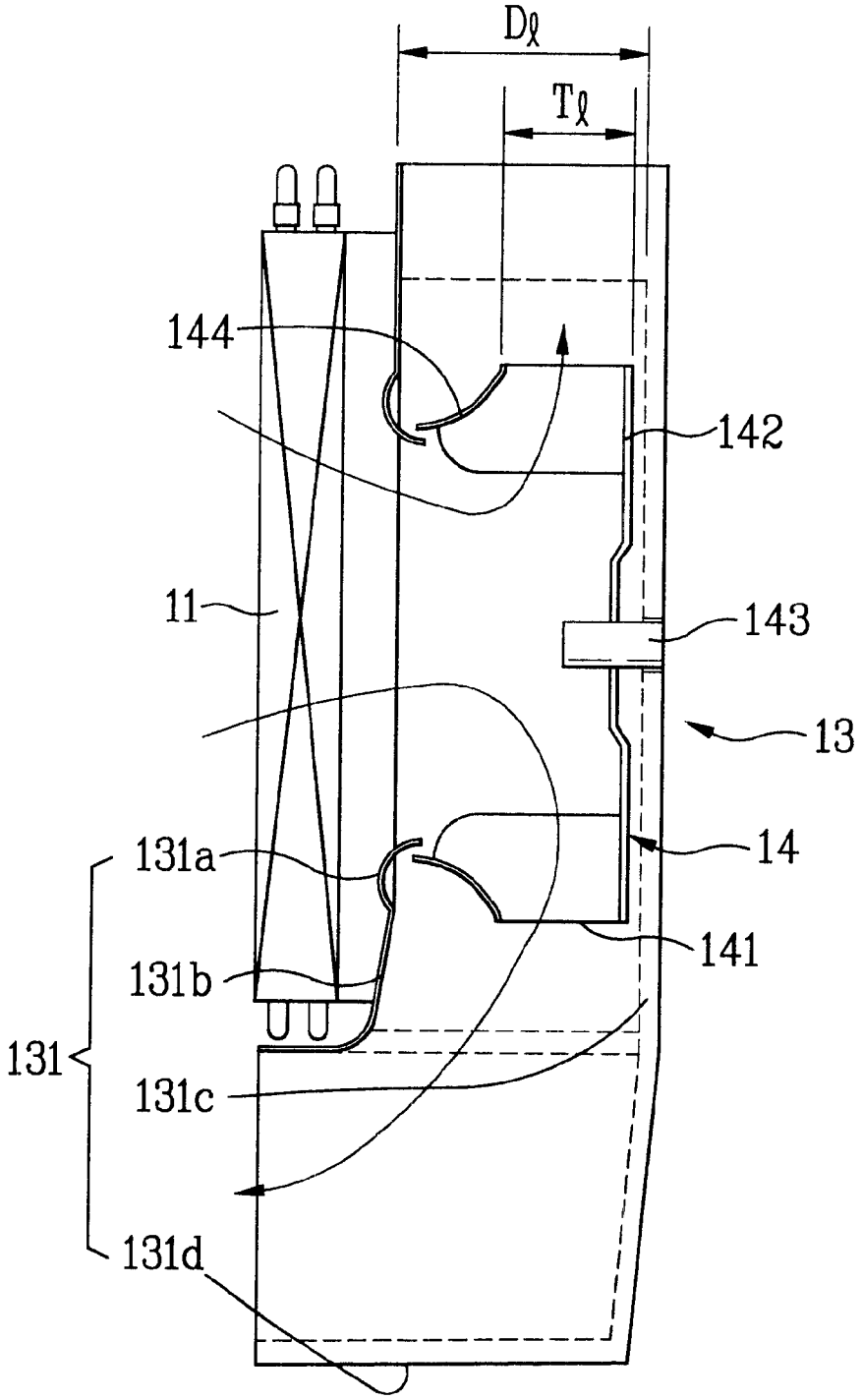
FIG. 5 illustrates a section across a line II—II FIG. 4 showing a turbo fan housing having an indoor heat exchanger and an inlet plate of the present invention applied thereto; and, FIG. 6 illustrates a front view of FIG. 5.
Figure 6:
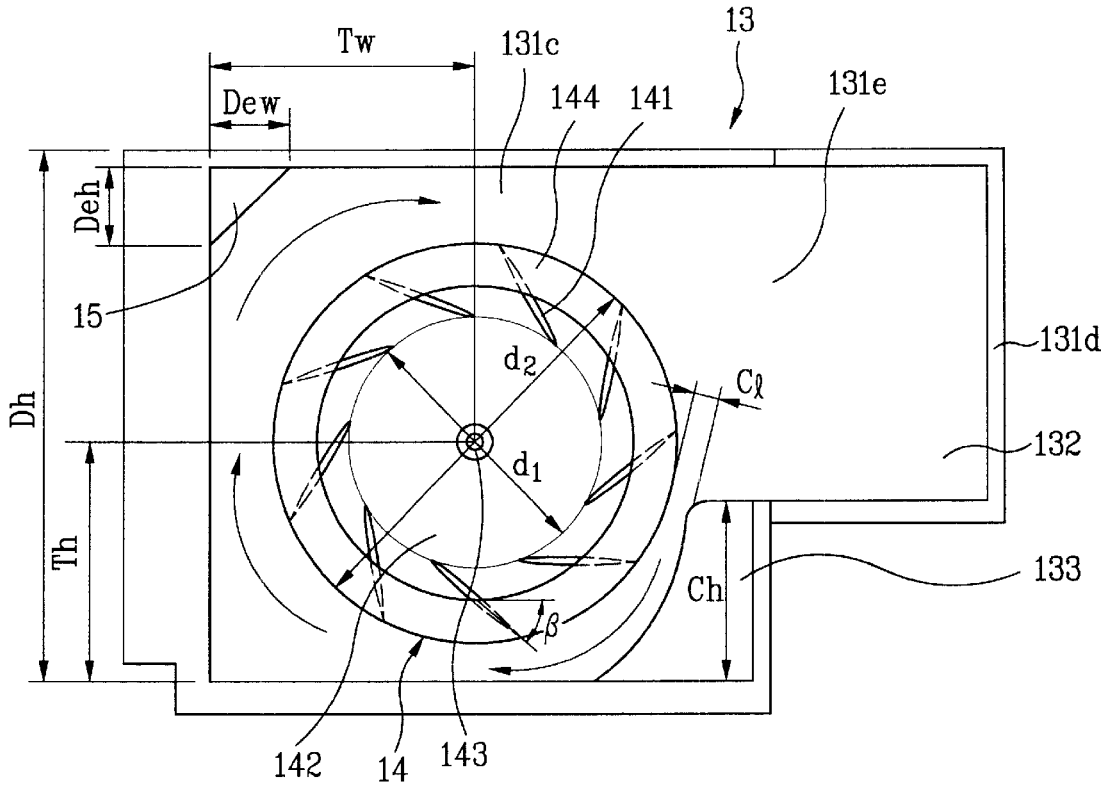

Referring to FIGS. 4–6, the turbo fan housing in accordance with a preferred embodiment of the present invention includes a flow guide 131 and an outlet 132, basically. The flow guide 131 includes an inlet plate 131*b* having a bell mouth 131*a* for guiding room air from an indoor heat exchanger 11, a base plate 131*c* opposite to the inlet plate 131*b*, and a separation wall 131*d* between the inlet plate and the base plate 131*b* and 131*c* to surround the turbo fan 14. And, the outlet 132 is formed by extension of the base plate 131*c* and the separation wall 131*d* from an opening 131*e* on one side of the flow guide 131, for discharging the room air from the turbo fan 14 to forward of the flow guide 131. And, there is a cutoff 133 formed on an inside of the separation wall 131*d* connecting the outlet 132 and the flow guide 131.

As described, the turbo fan 14 is employed in the window type air conditioner for enhancing an efficiency of the window type air conditioner since the turbo fan 14 has a good fan efficiency. FIG. 6 illustrates a front view of a turbo fan housing 13 in accordance with a preferred embodiment of the present invention having a turbo fan 14 mounted therein.

Referring to FIG. 6, the turbo fan 14 has backward-curved, streamlined blades 141 each with an outlet angle $\beta$ below 90°, with a ratio of an inside diameter d1 to an outside diameter d2 being smaller than 0.8. The backward-curved, and streamlined features of the blades 141 provide a high efficiency compared to an existing sirocco fan. However, due to the poor static pressure and flow rate of the indoor part in comparison to the bulk size, the present invention enhances the static pressure and the flow rate by using the following means.

Means for enhancing the static pressure of the indoor part will be explained.

There is a flow passage between the turbo fan 14 and the flow guide 131, for flowing of the room air from the turbo fan 14 to the opening 131*e* by the blades 141 of the turbo fan. The a turbo fan housing of the present invention provides a sudden direction change of an air flow, so that a portion of dynamic pressure of the room air is converted into a static pressure. In the preferred embodiment of the present invention, as shown in FIG. 6, a section of the flow guide 131 is form to be rectangular for boosting the static pressure of the room air every time the room air changes a flow direction. Though the section of the flow guide 131 is formed to be rectangular as an embodiment of the present invention, the section of the flow guide 131 may be of any form, such as polygon or curve, as far as the flow direction of the air can be changed, suddenly. And, the cutoff 133 is provided at a corner between a bottom of the separation wall 131*d* and a vertical plate of the opening 132. Especially, an inside of the cutoff 133 in contact with the turbo fan 14 is formed in a scroll form. Therefore, a sectional area of the flow passage formed between an outside diameter of the turbo fan 14 and the inside surface of the cutoff 133 is formed to be gradually greater as it goes in a direction of the opening 131*a*, resulting to boost the static pressure of the room air.

Means for increasing the flow rate to the maximum in the present invention will be explained.

First, in order to increase the flow rate to the maximum, it is required to maximize a size of the flow passage, which is varied with sizes, and relative mounting positions of the turbo fan housing 13, the turbo fan 14, and the cutoff 133. The sizes and relative positions of the turbo fan housing 13, the turbo fan 14, and the cutoff 133 obtained through experiments are as follows.

When a length D1 of the turbo fan housing is defined as a distance between the inlet plate and the base plate 131*b* an d 131*c*, and an outlet length T1 of the turbo fan is defined to be a distance between an outside diameter of a main plate 142 and a rim outside diameter, a result of the experiment coming from a relative length of the turbo fan housing length D1 and the turbo fan outlet length T1 will be discussed; forming the turbo fan housing length D1 to the maximum is favorable in view of the flow rate and a noise. However, a too long turbo housing length D1 leads to a too large sectional area of the flow passage, which drops the dynamic pressure too much. When the turbo fan outlet length T1 is 40–50% of the turbo fan housing length D1 {T1=(0.40–0.50)*D1)}, the flow rate can be made the maximum while the dynamic pressure is maintained.

And, when a turbo fan outside diameter d2 is defined to be the farthest distance between outer ends of the blades 141, and a turbo fan housing height is represented as Dh, a result of the experiment coming from relation between outside diameter d2 and the fan housing height Dh will be discussed; the flow rate becomes the greater as the out side diameter d2 of the turbo fan is made the greater. However, a too great turbo fan outside diameter d2 results in a poor efficiency, and noise increase of the turbo fan 14, and a too small turbo fan outside diameter results in poor flow rate even if the noise is gone. When the turbo fan outside diameter d2 is 72–82% of the turbo fan housing height Dh {d2=(0.72–0.82)2*Dh}, the noise is minimized and the flow rate is maximized.

And, a result of the experiment coming from relation between a height Th up to the rotation shaft 143 and a height Dh of the turbo fan housing will be discussed; it is found that a too low or high height Th of the rotation shaft results in a too great flow height difference between top and bottom of the turbo fan 14 and top and bottom of the turbo fan housing 131, which are not favorable in view of flow rate. When the height of the rotation shaft Th is 40–48% of the turbo fan housing height Dh {Th=(0.40–0.48)*Dh}, the flow rate is maximized.

And, when a mounting width Tw denotes a horizontal distance between the rotation shaft 143 and the left side vertical separation wall 131*d* in FIG. 5, a result of the experiment coming from the mounting width Tw will be discussed; a too small or too great mounting width Tw of the rotation shaft results in a great width difference of the flow passage formed between left and right sides of the turbo fan 14 and the left side vertical separation wall 131*d* and the cutoff 133, which is not favorable in view of the flow rate. When the mounting width Tw of the rotation shaft is 45–53% of the turbo fan housing height Dh {Tw=(0.45–0.53)*Dh}, the flow rate is maximized.

And, a distance between an upper inside surface of the cutoff 133 and an outside diameter d2 of the turbo fan is represented as a cutoff distance C1, a result of the experiment coming from the cutoff distance C1 will be discussed; even though a too small cutoff distance C1 increases the flow rate, it is not favorable in view of noise, and a too great cutoff distance C1 is not favorable in view of the static pressure even though the too great cutoff distance C1 reduces noise. When the cutoff distance C1 is 7–14% of the turbo fan outside diameter d2 {C1=(0.07–0.14)*D}, the noise can be minimized, while the flow rate can be maximized.

And, a distance between an upper inside surface of the cutoff 133 and an outside diameter d2 of the turbo fan is represented as a cutoff distance C1, a result of the experiment coming from the cutoff distance C1 will be discussed; even though a too small cutoff distance C1 increases the flow rate, it is not favorable in view of noise, and a too great cutoff distance C1 is not favorable in view of the static pressure even though the too great cutoff distance C1 reduces noise. When the cutoff distance C1 is 7–14% of the turbo fan outside diameter d2 {C1=(0.070–0.14)*D, the noise can be minimized, while the flow rate can be maximized.

And, a result of the experiment coming from a height Ch of the cutoff 133 will be discussed; the turbo fan housing is designed such that a top surface(peak) of the cutoff 133 and the bottom of the outlet 14 come on the same plane, for maximizing an outlet area of the outlet 132, thereby maximizing the flow rate. When the top of the cutoff 133 is higher than the bottom of the cutoff 132, though the static pressure of the room air increases, the flow rate is decreased.

Finally, when it is intended to increase the flow rate of the room air, rather than to increase the static pressure of the room air, a deflector 15 may be further fitted to a corner of the separation wall 131 data position diagonal to the cutoff 133, for changing a direction of the room air, moderately. In this instance, identical width Dew and height Deh of the deflector which respectively are 10–20% of the height Dh of the turbo fan housing {Dew=Deh=(0.01–0.20)*Dh} provides a maximum flow rate.

In the aforementioned turbo fan housing 13 in a window type air conditioner having the turbo fan 14 of the present invention applied thereto, upon putting the turbo fan 14 into operation, the room air from the turbo fan 14 is guided to the cutoff 133 with a slight reduction of a speed, proceeds in a horizontal direction along a lower portion of the flow guide 131 until the room air changes the flow direction to proceed upward along a vertical portion of the flow guide 131, and changes the flow direction again to proceed in a horizontal direction along a top portion of the flow guide 131. Thus, since the speed of the room air drops every time the room air changes the flow direction, to convert a portion of the dynamic pressure of the room air into the static pressure, the room air can be discharged through the outlet 132, with the boosted static pressure kept, thereby permitting to boost the static pressure of the room air owing to a flow passage structure despite of the low static pressure of the turbo fan 14. Moreover, since the sectional area of the flow passage the room air passes therethrough becomes the maximum owing to a structure of the turbo fan housing 13, the flow rate of the indoor part is increased. And, when the deflector application to a right upper portion permits a smooth room air flow, to increase the flow rate further, even though the static pressure drops, slightly.

As has been explained, the turbo fan housing in a window type air conditioner of the present invention has the following advantages.

An efficiency of a window type air conditioner can be improved by applying a turbo fan with a high fan efficiency to a turbo fan housing, and a high flow rate and a high static pressure are still obtainable even if the turbo fan with a low flow rate and a low static pressure is employed by optimizing a structure of the turbo fan housing.

It will be apparent to those skilled in the art that various modifications and variations can be made in the turbo fan housing in a window type air conditioner of the present invention without departing from the spirit or scope of the invention. Thus, it is intended that the present invention cover the modifications and variations of this invention provided they come within the scope of the appended claims and their equivalents.

What is claimed is:

1. A turbo fan housing in a window type air conditioner comprising:

a flow guide including an inlet plate having a bell mouth for guiding room air, a base plate opposite to the inlet plate having an indoor fan mounted thereto for drawing the room air, and a separation wall between the inlet plate and the base plate to surround the turbo fan;

an outlet formed by an extension of the base plate and the separation wall from an opening formed on one side of the flow guide; and, a cutoff formed on an inside of the separation wall connecting the outlet and the flow guide, wherein, the indoor fan is a turbo fan, and a flow passage in the flow guide is formed to cause sharp flow direction changes, for converting a portion of dynamic pressure of the room air into a static pressure in the flow direction changes, and wherein the cutoff is provided at a corner formed by a bottom of the separation wall and a vertical surface of the outlet.

2. The turbo fan housing as claimed in claim 1, wherein the flow guide formed by the separation wall is rectangular.

3. The turbo fan housing as claimed in claim 2, wherein an inside surface of the cutoff opposite to the turbo fan is a scroll form.

4. The turbo fan housing as claimed in claim 3, wherein the turbo fan has an outlet length (T1) approx. 40–50% of a turbo fan housing length (D1), an outer diameter (d2) approx. 72–82% of a turbo fan housing height (Dh), a height (Th) to a rotation shaft of the turbo fan is 40–48% of the turbo fan housing height (Dh), a mounting width (Tw) of a turbo fan rotation shaft is 45–53% of the turbo fan housing, a cutoff distance (C1) from an upper inside surface of the cutoff to the outer diameter (d2) of the turbo fan is 7–14% of the outer diameter (d2) of the turbo fan, and a top surface of the cutoff and a bottom surface of the outlet are on the same plane.

5. The turbo fan housing as claimed in any one of claims 1–4, further comprising a deflector at the corner of the separation wall in a diagonal direction from the cutoff for moderate direction change of the room air.

6. The turbo fan housing as claimed in claim 5, wherein the deflector has identical width (Dew) and height (Deh) and is 10–20% of the turbo fan housing height (Dh).

* * * * *